US005431031A

United States Patent [19]

Vinas

[11] Patent Number: 5,431,031

[45] Date of Patent: Jul. 11, 1995

[54] MACHINE FOR THE WET TREATMENT OF FABRICS

[75] Inventor: Jaume A. Vinas, Matadepera, Spain

[73] Assignee: Jaume Anglada Vinas, S.A., Llagosta, Spain

[21] Appl. No.: 312,107

[22] Filed: Sep. 26, 1994

[30] Foreign Application Priority Data

Sep. 28, 1993 [EP] European Pat. Off. ..... 9302046

[51] Int. Cl.[6] ..... D06B 3/24; D06B 3/28

[52] U.S. Cl. ..... 68/5 D; 68/9; 68/18 F; 68/20; 68/22 R; 68/178

[58] Field of Search ..... 68/5 D, 9, 18 F, 20, 68/22 R, 177, 178

[56] References Cited

U.S. PATENT DOCUMENTS

| | | | |
|---|---|---|---|
| 3,330,134 | 7/1967 | Carpenter | 68/178 X |
| 3,700,404 | 10/1972 | Janisch et al. | 68/22 R X |
| 3,981,162 | 9/1976 | Klier | 68/9 X |
| 4,006,612 | 2/1977 | Thies | 68/177 |
| 4,020,658 | 5/1977 | Thies | 68/177 X |
| 4,107,801 | 8/1978 | Tachibana | 68/22 R X |
| 4,440,003 | 4/1984 | Koch | 68/22 R |
| 4,468,937 | 9/1984 | Bertoldi | 68/22 R X |
| 5,014,525 | 5/1991 | Bene | 68/20 |
| 5,046,209 | 9/1991 | Keilhack | 68/22 R X |

*Primary Examiner*—Philip R. Coe

*Attorney, Agent, or Firm*—McGlew and Tuttle

[57] ABSTRACT

The machine comprises: two or more modules, each having two containers and each container having two vertical vessels with respective open upper ends; a bottom portion places the vessels in communication with each other. Each module has two, alternately operating, hydraulic fabric drive means, situated above the open upper ends of the vessels; for each module a pumping means draws liquor from the containers, forces it through a filter and sends it to the hydraulic drive means. A fan blows air to a guide means for leading the fabric from one container to another and the guide means is provided at the top thereof with a cylindrical configuration having a horizontal generating line allowing the air through and forming an air cushion between the fabric and the guide means.

11 Claims, 4 Drawing Sheets

MACHINE FOR THE WET TREATMENT OF FABRICS

BACKGROUND OF THE INVENTION

1. Field of the Invention

The invention relates to a machine for the wet treatment of fabrics, by a supply of liquor, the machine having an input device for the slow infeed of the fabric and a delivery device for the slow delivery of the fabric.

2. Reference to the Prior Art

The wet treatment of fabrics is frequently carried out on a piece in "rope" form, i.e. a piece of fabric longitudinally rolled up and being joined at the ends. This fabric rope is inserted in a closed circuit where it has to remain for a considerable time. At the end of the treatment, it is laborious to unwind the piece again. Furthermore, more or less considerable stresses are created, resulting in an undesired stretching of the fabric in the warp direction.

In other known processes, the fabric is treated in "open width" form, i.e. without it being necessary to wind it longitudinally, as mentioned above. Nevertheless, for the fabric to be in contact with the treatment liquor for sufficient time, long, bulky installations are required, which obviously involves a notable increase in cost. Furthermore, undesirable stresses and lengthening of the treated fabric regularly occur.

Reference may also be made to systems using vibratory drums which oscillate on an offset axis, whereby the fabric is subjected to alternating hydraulic pressures. A good exchange between the liquor and the fabric and a correct removal of the particles of dirt on the fabric are achieved, Nevertheless, these last named systems are onerous.

BRIEF SUMMARY OF THE INVENTION

The invention seeks to provide a machine for the wet treatment of fabrics, with which the above mentioned drawbacks are overcome and at the same time a satisfactory treatment is achieved. This object is achieved with a machine of the type referred to at the beginning which is characterized in that it comprises: (a) at least two modules, each one having a first container and a second container, each container defining a first generally vertical vessel having an open upper end, a second generally vertical vessel having an open upper end and a bottom portion placing said vessels in communication one with the other; (b) two, alternately operating hydraulic fabric drive means, respectively situated above the open upper end of one vessel of the first container and above the open upper end of an adjacent vessel of the second container; (c) a pumping means for each module, capable of drawing the liquor from the first and second containers and delivering it to said hydraulic drive means; (d) a filter inserted in said pumping means; (e) a fan; and (f) a guide means for leading the fabric from one to the other container of one same module, said guide means receiving air from said fan and having at the top thereof a cylindrical configuration having a horizontal generating line, allowing said air to pass therethrough to form an air cushion or pneumatic pulley between the fabric and said guide means.

BRIEF DESCRIPTION OF THE DRAWING

Further advantages and features of the invention will be appreciated from the following description, in which there is described without any limiting nature a preferred embodiment of the invention, with reference to the accompanying drawings, in which.

DETAILED DESCRIPTION OF THE INVENTION

Figure 1:
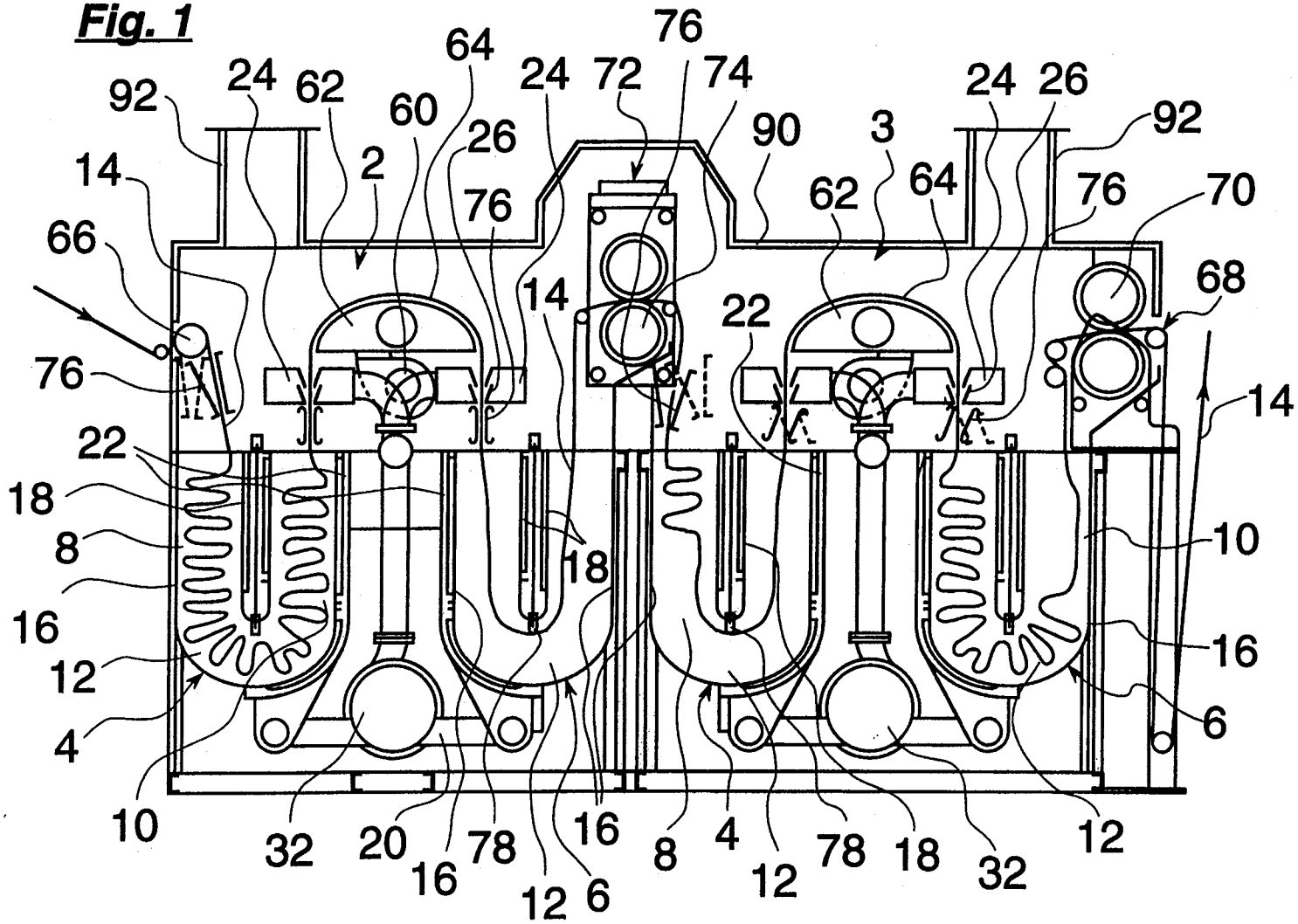
FIG. 1 is a schematic longitudinal section view of one embodiment of the machine of the invention, comprising two modules; the figure includes a schematic representation of the fabric.

The machine comprises at least two modules 2, 3. In the embodiment illustrated, the module 2 at the lefthand side in FIG. 1 is for applying any desired treatment, such as scouring, bleaching, optical bleaching, dyeing, vaporizing, removal of oiling, sizing or any other, while the module 3 at the righthand side is for rinsing the fabric, without this meaning that the rinsing operation is necessary for all treatments.

The modular constitution of the machine allows one same machine to be equipped with a first module for a specific treatment (i.e. scouring), a second module for another treatment (i.e. dyeing), a third module for a third treatment, to conclude preferably with a final rinsing module. There is also contemplated the possibility of two or more modules (consecutive or otherwise) being arranged for one same treatment, whereby a faster treatment time may be achieved. Where the machine used has, in certain cases, more modules than required for a particular treatment or for the amount of fabric to be treated, there is the possibility of "neutralizing" one or more of the modules by filling them only with clear water.

Figure 2:
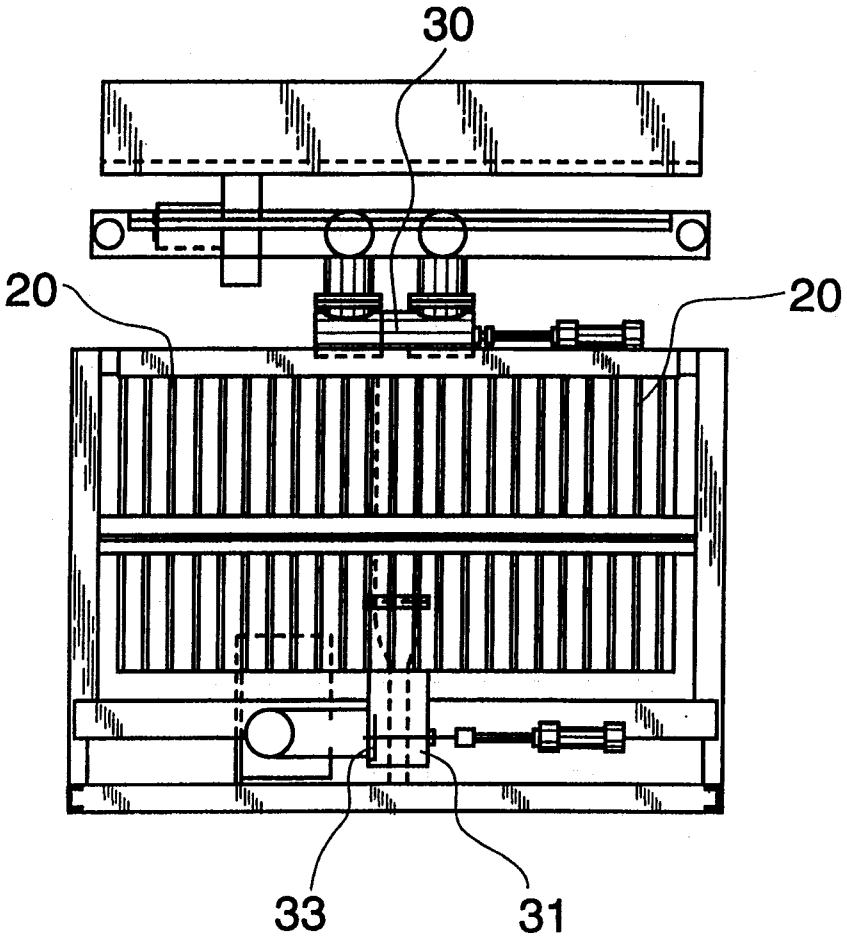
FIG. 2 is a schematic cross section view of the same machine.

Each module 2 is equipped with a first container 4 and a second container 6 and each container is formed by a first vessel 8 and a second vessel 10, both generally vertical, which are in communication over a bottom portion 12. The vessels 8 and 10 have respective open upper ends of generally rectangular shape. The major dimension of the rectangle is the one disposed perpendicularly to the plane shown in FIG. 1 (whereby it is not to be appreciated therein) and its size is appropriate to the open width of the fabric 14. This major dimension may be seen in FIG. 2.

The containers 4 and 6 are preferably defined by an outer wall 16 of right U section and by an inner wall 18, also of right U section, having a smaller height and width than the outer wall and being comprised within the latter. In FIG. 1 the right section of the containers 4, 6 in the lengthwise direction of the machine is precisely to be appreciated and this right section is preferably constant.

For reasons to be explained hereinafter, each of the outer and inner walls 16 and 18 has a plurality of passages 20 communicating with the exterior and these passages are not to be found only in the bottom portions of the vessels 8, 10, but they extend also over practically the whole of one vertical limb of the wall 16. Said passages 20 are preferably in the vertical portions of the outer wall 16 and/or inner wall 18 of the vessels 8,10, above the open upper ends of which there is a hydraulic drive means 24, to be referred to hereinafter. In other words, these passages are situated in the vessels alternately receiving the fabric from the other container 4,6 of the same module 2,3 (second vessel 10 of the first container 4 and first vessel 8 of the second container).

The passages 20 are also preferably formed by slots along a portion of the wall 16. In the regions where the passages 20 are formed, there are respective jackets 22 which collect the liquor flowing through the passages 20 and lead it away to a pumping means to be referred to hereinafter.

Situated above the open upper end of the second vessel 10 of a first container 4 of one module 2,3 and the open upper end of the first vessel 8 of a second container 6 of a module 2,3 (i.e., preferably adjacent vessels of the containers of one same module), there are hydraulic drive means 24, provided with nozzles 26 adapted for forcing the fabric downwardly (i.e. towards the respective vessel 8, 10).

A pumping means 28 for each module 2,3 draws the liquor emerging through the passages 20 of the containers 4,6 and directs it to the drive means 24. The pumping means 28 have a variable flowrate and pressure, to be able to be adapted to different fabrics and different treatments. Such pumping means 28 has a three way valve 30 alternately directing the liquor aspirated from the containers to one drive means 24 or the other. A further valve 32 is provided with a piston 33 adapted to close or open the access of liquor from one container 4,6 towards the pumping means 28.

There is a filter 32 inserted in the pumping means 28. The impurities entrained in the liquor are collected in the filter and directed to the outside of the machine, preventing their reincorporation in the container through one of the drive means 24.

Figure 3:
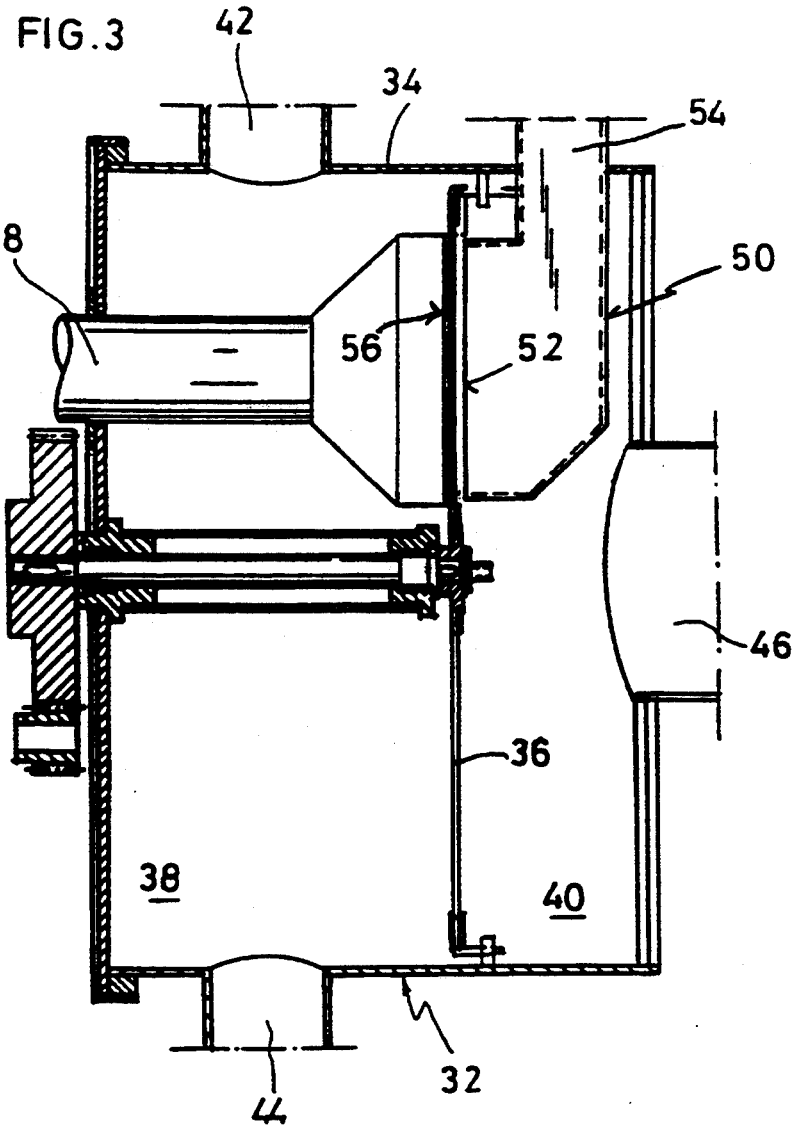
FIG. 3 is a cross section view, on a larger scale, showing with further detail a preferred embodiment of the machine filter.
Figure 4:
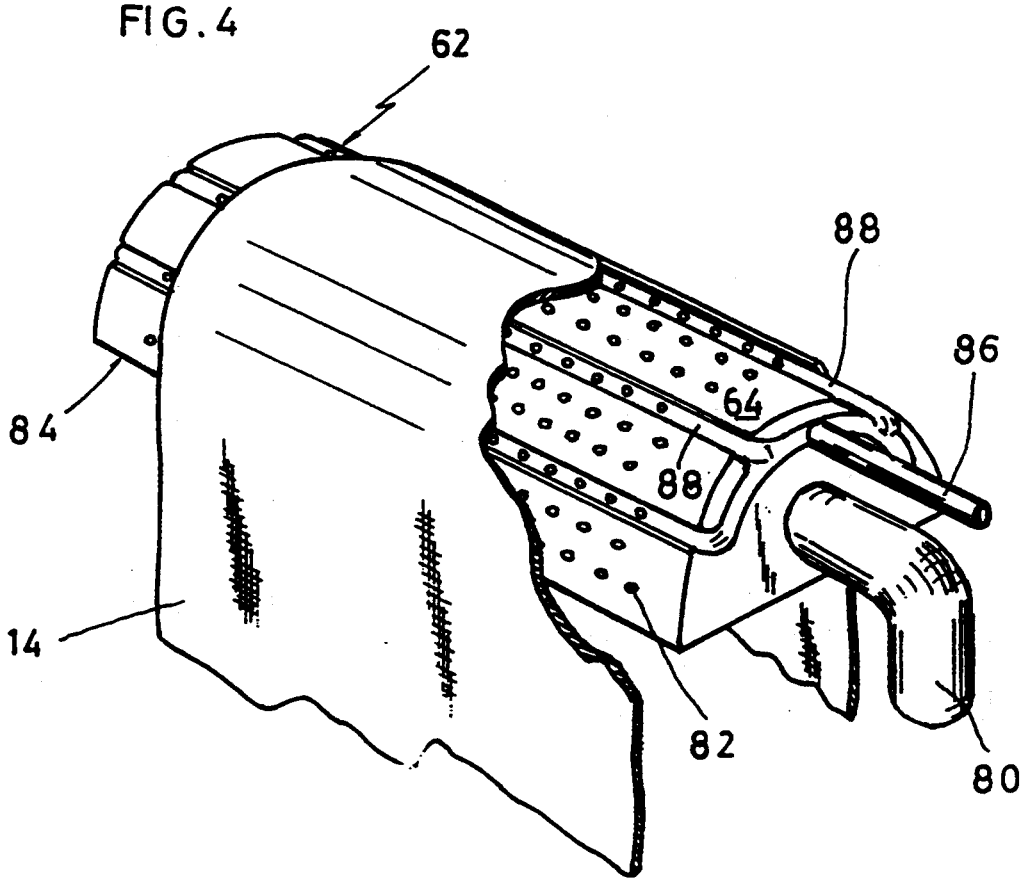
FIG. 4 is a schematic perspective view of the guide means for leading the fabric between two containers of one same module, the fabric being shown fractionally to allow the guide means to be seen.
Figure 5:
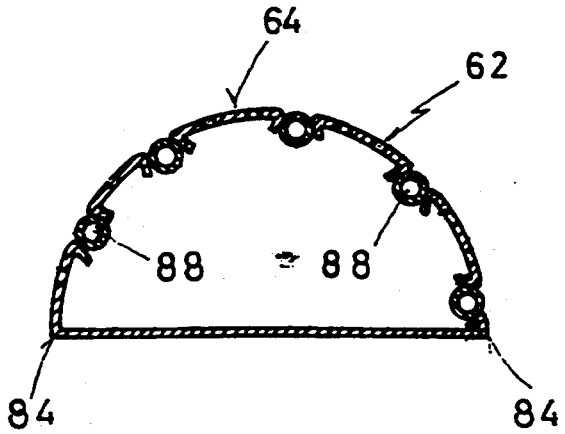
FIG. 5 is a schematic cross section view in elevation of a guide means having five steam pipes.

Preferably (FIG. 3), the filter 32 comprises a chamber 34, in which there is a screen 36 dividing it into a first compartment 38 and a second compartment 40. The first compartment 38 alternately receives liquor from one of the containers and to this end is provided with pipes 42 and 44 placing it in communication with each of the containers; the second compartment 40 is provided with a pipe 46 through which the liquor reaches the pumping means, to be sent to the hydraulic drive means 24 corresponding to the container from which liquor is being received.

The screen 36 dividing the compartments 38, 40, preferably made with metallic filter cloth, is permeable to the liquor but does not allow the passage therethrough of the solid particles (such as lint and the like) which may have become separated from the fabric and which usually adheres to the screen, The screen may rotate about a shaft 48 and the active portion thereof is annular. When the screen 36 has retained a certain amount of impurities, its permeability to the liquor becomes reduced.

To solve this difficulty, a cleaning device 50 is provided. This comprises a first port 52, preferable of rectangular section, which is applied close to one side of the screen and which extends so as to cover a radial area of the annulus. Obviously, when the screen 36 has made a complete rotation, the first port 52 traverses the whole of the screen surface. Such port 52 is adapted to receive clean liquor from the pumping means 28, to which end it is provided with a pipe 54. A second port 56, substantially the same as the first port 52 and opposite thereto, is applied to the other side of the screen 36 and, by means of an outlet pipe 58, is in communication with the outside for removal of the waste liquor. With a programmed periodicity, a not shown inlet valve opens the passage of the clean liquor from the pumping means and this liquor is forced through the pipe 54, through the first port 52, crosses through the screen 36 entraining with it the impurities retained by the screen, enters in the second port 56 and the liquor and the impurities therewith, is driven out through the pipe 58, which is also controlled by a valve which opens at the same time as the said inlet valve.

The machine also comprises a fan 60 and a guide means 62 for transferring the fabric 14 from one container 4,6 to the other of the same module 2,3. The guide means has at the top portion a cylindrical configuration 64 with a horizontal generating line. This term is intended to designate any cylindrical configuration, even one generated by a line which, while being constantly parallel to itself, has an other than circular movement. The guide means 62, through a pipe 80, received air from the fan 60 and allows this air to flow through its upper cylindrical surface, thereby allowing an air cushion or pneumatic pulley to be formed between the fabric 14 and the guide means 62, having a pulley effect with practically no friction between the guide means and the fabric.

The air flows through a plurality of holes 82 which are preferably disposed in several longitudinal parallel lines. It is particularly preferred that the hole density be greater in the longitudinal areas of the guide means closest to the longitudinal edges 84 thereof. This greater hole density may be achieved by reducing the spacing between adjacent lines.

There is obviously an infeed device 66 for the gradual infeed of the fabric into the machine, as well as a delivery device 68 for the gradual exit of the fabric. Both devices comprise conventional means the description of which is omitted, although mention is made of a pair of rollers 70 in the delivery device 68, facilitating draining of the liquor at the exit.

Between the two modules 2,3 there is a member 72 for transferring the fabric between modules and which comprises a pair of intermediate wringing rollers 74, very similar to the pair of delivery rollers 70.

The infeed device 66, the transfer member 72 and/or the hydraulic drive means 24 are preferably provided with respective reciprocating mechanisms 76 allowing the fabric to be delivered in successive folds which are generally superimposed on each other, as shown in FIG. 1.

Each of the inner walls 18 is provided at the lower end thereof with a fabric exhaustion sensor 78, to be referred to hereinafter, which produces the reversal of the operation of the hydraulic drive means 24.

One or more modules 2,3 may be provided with a steam source, which is preferably a conventional steam generator, as well as a pipe 86 so that the steam produced may reach the guide means 62. When it is intended to steam the fabric to warm it appropriately for certain treatments (for example, dyeing or treatments in which it is desirable to promote certain chemical reactions with a supply of heat), this steam flows through the surface 64 of the guide means 62, either at the same time as the air from the fan 60, or instead of this air, forming in either case the said air cushion or pneumatic pulley between the fabric and the guide means 62.

When the steam flows together with the air, there may be different areas on the surface 64 for the air flow and for the steam flow (tubes 88 branched from the pipe 86). Air and steam may also flow through the same holes.

Also contemplated is a structure 90 for encasing each module 2,3, whereby the fumes produced during the process may be removed. Exhaust stacks 92 facilitate such removal.

The operation of the machine is easily to be appreciated from the foregoing description. The fabric 14 reaches the first container 4 of the first module 2 through the infeed device 66. In the container it is inserted in the corresponding treatment liquor and the fabric 14 is caused to advance so that it passes through the drive means 24, covering the guide means 62, enters in the second container 6 and continues through the removal device 72 from where it is caused to perform the same movements in the second module 3 as described for the module 2 until it leaves through the delivery device 68. Unless otherwise provided for, up to the end of the treatment the fabric is continuously gradually fed into the machine and in the same way there is a continuous gradual delivery.

When the fabric 14 is entering in the vessel of one container (e.g., the second vessel 10 of the first container 4), the pumping means 28 draws the liquor from this container (in this case the first container 4), thereby creating a suction which layouts the fabric infeed in the container 4 and also the accumulation and storage of the fabric in the container 4, providing a superior true capacity. Furthermore, the fact that the passages 20 are in the vertical portions of the walls 16, 18 of the vessels receiving the fabric from the other container 4,6 (in this case, the second vessel 10 of the first container 4), also provided a downward effect in the vessel 10 itself, favouring also its entry and storage.

The liquor drawn by the pumping means 28 from the container in which the fabric is entering, is caused to flow through the drive means 24 corresponding to the first container 4, without any liquor being removed at that time from the second container 6 or being supplied to the drive means for the second container 6. The drive means receiving the liquor forces the fabric 14 at high speed into the second container 6 and the fabric flows quite smoothly and practically friction-free over the guide means 62, thanks to the air cushion or pneumatic pulley formed between the said cylindrical configuration 64 and the fabric 14 itself, since the latter is highly impregnated with liquor, making it impermeable to the air supplied by the fan 60. It is highlighted that the fabric falls from the drive means into the corresponding vessel in such a way as highly to compact the fabric.

When the fabric, on being exhausted, has become taut inside a container (such as shown in the second container 6 of the first module 2), it operates the sensor 78, which provides a signal causing operation of the three way valve 30, whereby the pumping means 28 ceases to draw liquor from one container and direct liquor to one drive means and starts to draw it from the other container and direct it to the other drive means, thereby reversing the fabric movement. The time between the drive in one direction and the drive in the other direction is controlled by an automatic device, through which the amount of fabric in each module may be varied. The fabric is caused to pass alternately from one container to another as often as required to obtain the treatment. Obviously, in the second module (and possibly in the successive modules) the same operations and alternations are taking place, whereby the pertinent treatment being performed in this second module is carried out substantially simultaneously.

What I claim is:

1. A machine for the wet treatment of fabrics, by a supply of liquor, the machine having an input device for the slow infeed of the fabric and a delivery device for the slow delivery of the fabric, comprising: (a) at least two modules, each one having a first container and a second container, each container defining a first generally vertical vessel having an open upper end, a second generally vertical vessel having an open upper end and a bottom portion placing said vessels in communication one with the other; (b) two, alternately operating hydraulic fabric drive means, respectively situated above the open upper end of one vessel of the first container and above the open upper end of an adjacent vessel of the second container; (c) a pumping means for each module, capable of drawing the liquor from the first and second containers and delivering it to said hydraulic drive means; (d) a filter inserted in said pumping means; (e) a fan; and (f) a guide means for leading the fabric from one to the other container of the same module, said guide means receiving air from said fan and having at the top thereof a cylindrical configuration having a horizontal generating line, allowing said air to pass therethrough to form an air cushion of pneumatic pulley between the fabric and said guide means.

2. The machine of claim 1, wherein each container is bounded by a right section U-shaped outer wall and a right section U-shaped inner wall.

3. The machine of claim 2, wherein over at least a part of the vertical portions thereof, said outer and inner walls are provided with a plurality of passages to the outside, there being a jacket adapted to collect the liquor flowing through said passages, leading it to said pumping means.

4. The machine of claim 3, wherein said passages are located on the vertical portions of the outer wall and/or inner wall of the vessels above the open upper end of which there is a hydraulic drive means.

5. The machine of claim 2, wherein said inner wall is provided with a fabric exhaustion sensor, said sensor being adapted to give a signal reversing the operation of said hydraulic drive means.

6. The machine of claim 1, wherein for each module there is a member transferring the fabric between the modules, said member having a pair of fabric removal rollers, adapted to press therebetween the fabric on the delivery thereof from the second container of each module, squeezing out the liquid it contains.

7. The machine of claim 1, wherein said infeed device, said member for transferring the fabric between modules and/or said hydraulic drive means comprise a reciprocating mechanism for the delivery of the fabric forming successive generally superimposed folds.

8. The machine of claim 1, wherein in at least one module, the vessel of the first container above the open upper end of which there is one hydraulic drive means and the vessel of the second container above the open upper end of which there is the other hydraulic drive means are contiguous.

9. The machine of claim 1, wherein said pumping means is adapted to draw liquor from a single container and direct it only to the hydraulic drive means situated above the open upper end of a vessel of the same container.

10. The machine of claim 1, wherein at least one module has a steam source and a pipe leading the steam produced to said guide means.

11. The machine of claim 1, wherein said filter comprises a chamber in which a rotating screen permeable to liquids and impermeable to solids forms a first compartment for receiving liquor from the containers and a second compartment in communication with said pumping means, there being a circuit formed by: (a) a pipe for the admission of clean liquor; (b) a first port of said pipe, applied in the proximity of a radial portion of said screen on the second compartment side thereof; (c) a pipe for the removal of impurity-containing liquor; (d) a second port of said pipe, facing said first port and which is applied in the proximity of said radial portion of said screen on the first compartment side thereof.

* * * * *

UNITED STATES PATENT AND TRADEMARK OFFICE

CERTIFICATE OF CORRECTION

PATENT NO. : 5,431,031

DATED : July 11, 1995

INVENTOR(S) : Anglada Vinas

It is certified that error appears in the above-indentified patent and that said Letters Patent is hereby corrected as shown below:

On the title page, items [19] and [75], Inventor last name "Vinas" should read -- Anglada Vinas--.

Signed and Sealed this

Twenty-sixth Day of September, 1995

*Attest:*

Bruce Lehman

BRUCE LEHMAN

*Attesting Officer*

*Commissioner of Patents and Trademarks*